US010337717B2

(12) United States Patent
Ozawa et al.

(10) Patent No.: US 10,337,717 B2
(45) Date of Patent: Jul. 2, 2019

(54) LIGHT SOURCE UNIT, METHOD OF MANUFACTURING THE SAME, AND VEHICLE LAMP

(71) Applicant: KOITO MANUFACTURING CO., LTD., Tokyo (JP)

(72) Inventors: Atsushi Ozawa, Shizuoka (JP); Takuya Serita, Shizuoka (JP); Yoshimasa Murata, Shizuoka (JP); Ryota Naito, Shizuoka (JP); Takahiro Kumeta, Shizuoka (JP)

(73) Assignee: KOITO MANUFACTURING CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/084,591

(22) Filed: Mar. 30, 2016

(65) Prior Publication Data

US 2016/0290621 A1 Oct. 6, 2016

(30) Foreign Application Priority Data

Mar. 31, 2015 (JP) ..... 2015-072896
Feb. 5, 2016 (JP) ..... 2016-021207

(51) Int. Cl.

| | |
|---|---|
| ***F21S 43/19*** | (2018.01) |
| ***F21V 29/74*** | (2015.01) |
| ***F21S 43/14*** | (2018.01) |
| ***F21S 45/47*** | (2018.01) |
| *F21Y 115/10* | (2016.01) |
| *F21S 41/19* | (2018.01) |

(Continued)

(52) U.S. Cl.

CPC ..... *F21V 29/74* (2015.01); *F21S 43/14* (2018.01); *F21S 43/195* (2018.01); *F21S 45/47* (2018.01); *F21S 41/141* (2018.01); *F21S 41/192* (2018.01); *F21S 45/10* (2018.01); *F21Y 2115/10* (2016.08)

(58) Field of Classification Search

CPC . F21Y 2115/10; F21S 48/328; F21S 48/1154; F21S 48/215; F21S 48/115; F21S 48/321; F21S 48/325

See application file for complete search history.

(56) References Cited

U.S. PATENT DOCUMENTS 6,450,670 B1 * 9/2002 Strauss ..... F21S 45/48 362/294
7,621,667 B2 * 11/2009 Behr ..... F21V 29/004 362/651

(Continued)

FOREIGN PATENT DOCUMENTS

CN 102102838 A 6/2011
JP 201441738 A 3/2014

OTHER PUBLICATIONS

Communication dated Jan. 10, 2018, issued by the State Intellectual Property Office of the People's Republic of China in counterpart Chinese application No. 201610196548.7.

*Primary Examiner* — Christopher Stanford
(74) *Attorney, Agent, or Firm* — Sughrue Mion, PLLC

(57) ABSTRACT

In one embodiment of a light source unit, the heat-dissipation plate is provided with a first heat-dissipation portion in contact with the substrate, the resin molding part is provided with a plurality of heat-dissipation fins and an engaging portion to be engaged with a predetermined member, and the socket housing is formed by an integral molding of the heat-dissipation plate and the resin molding part.

13 Claims, 11 Drawing Sheets

(51) Int. Cl.
*F21S 41/141* (2018.01)
*F21S 45/10* (2018.01)

(56) References Cited

U.S. PATENT DOCUMENTS 7,806,562 B2 * 10/2010 Behr ..... F21K 9/00 362/294
2006/0098438 A1 * 5/2006 Ouderkirk ..... H05K 1/0203 362/294
2007/0035957 A1 * 2/2007 Albou ..... F21V 29/004 362/487
2008/0253126 A1 * 10/2008 Mizutani ..... B60Q 1/007 362/294
2010/0033972 A1 * 2/2010 Maglica ..... F21K 9/00 362/294
2011/0128754 A1 * 6/2011 Aiso ..... F21V 19/001 362/547
2012/0020104 A1 * 1/2012 Biebl ..... F21K 9/00 362/546
2012/0026747 A1 * 2/2012 Hayashi ..... F21V 31/04 362/520
2012/0075880 A1 * 3/2012 Hayashi ..... F21S 41/141 362/547
2013/0329443 A1 * 12/2013 Yasuda ..... F21S 45/48 362/516
2014/0043815 A1 * 2/2014 Chuang ..... F21V 29/004 362/249.02
2014/0355241 A1 * 12/2014 Takenaka ..... F21V 29/15 362/84
2015/0016136 A1 * 1/2015 Nakano ..... F21S 48/212 362/520
2016/0061436 A1 * 3/2016 Hino ..... F21V 29/74 362/373

* cited by examiner

LIGHT SOURCE UNIT, METHOD OF MANUFACTURING THE SAME, AND VEHICLE LAMP

CROSS-REFERENCE TO RELATED APPLICATIONS

This application claims priorities from Japanese Patent Applications No. 2015-072896 filed on Mar. 31, 2015 and No. 2016-021207 filed on Feb. 5, 2016, the entire contents of which are incorporated herein by reference.

FIELD

The present invention relates to a technical field of a light source unit which includes a socket housing and a substrate disposed in the socket housing, a method of manufacturing the light source unit, and a vehicle lamp including the light source unit.

BACKGROUND

For example, there is known a vehicle lamp in which a light source unit is detachably provided in an outer lamp housing constituted by a lamp body and a cover, and a light emitting element such as a light emitting diode is used as a light source of the light source unit.

In such a light source unit, the light emitting element serving as the light source, a wiring pattern for supplying current to at least the light emitting element, and a substrate formed with the wiring pattern are provided, and the substrate is disposed in a socket housing (e.g., JP2014041738A).

In the light source unit disclosed in JP2014041738A, the substrate is bent to have a U shape and a portion of the substrate is inserted into an opening portion formed in the socket housing.

By the way, in the light source unit as described above, it is necessary to secure a stable light-emitting state of the light emitting element by increasing the heat-dissipation of heat generated at the time of emission of light from the light emitting element.

However, in the light source unit disclosed in Patent Document 1, a portion of the substrate is located at the inside of the socket housing, and hence, there is a possibility that the heat released from the substrate is retained at the inside of the socket housing. Consequently, there is a risk that a sufficient heat-dissipation cannot be secured.

SUMMARY

Therefore, a light source unit and a vehicle lamp of the present invention aim to solve the above-described problems and to improve the heat-dissipation of heat generated at the time of emission of light from a light emitting element.

In the first, a light source unit according to the present invention includes, a socket housing that has a heat-dissipation plate formed of a metallic material and a resin molding part, a substrate mounted on the socket housing, and a light emitting element serving as a light source, and a and mounted on the substrate. The heat-dissipation plate is provided with a first heat-dissipation portion in contact with the substrate. The resin molding part is provided with a plurality of heat-dissipation fins and an engaging portion to be engaged with a predetermined member. The socket housing is formed by an integral molding of the heat-dissipation plate and the resin molding part.

In this way, at the time of emission of light from the light emitting element, heat is released from the heat-dissipation plate formed of the metallic material and the resin molding part formed of the thermal conductive resin material.

In the second, in the light source unit according to the present invention, it is preferable that the heat-dissipation plate is provided with a second heat-dissipation portion perpendicular to the first heat-dissipation portion.

In this way, heat is also released from the second heat-dissipation portion, in addition to the first heat-dissipation portion.

In the third, in the light source unit according to the present invention, it is preferable that the second heat-dissipation portion is positioned at an inside of an outermost heat-dissipation fin out of the plurality of heat-dissipation fins.

In this way, the strength of the outermost heat-dissipation fin is increased by the second heat-dissipation portion.

In the fourth, in the light source unit according to the present invention, it is preferable that the heat-dissipation plate is provided with a third heat-dissipation portion which is bent in a direction perpendicular to the first heat-dissipation portion and is continuous with the first heat-dissipation portion.

In this way, heat is also dissipated from the third heat-dissipation portion, in addition to the first heat-dissipation portion.

In the fifth, in the light source unit according, to the present invention, it is preferable that the heat dissipation plate is provided with a fourth heat dissipation portion which is bent in a direction perpendicular to both of the second heat-dissipation portion and the third heat-dissipation portion and is continuous with both of the second heat-dissipation portion and the third heat-dissipation portion.

In this way, heat is also dissipated from the fourth heat-dissipation portion, in addition to the first heat-dissipation portion, the second heat-dissipation portion and the third heat-dissipation portion.

In the sixth, in the light source unit according to the present invention, it is preferable that the socket housing is formed with a placement recess in which the substrate is placed, the substrate is attached to the heat-dissipation plate by an adhesive, and a gap is formed between an inner peripheral surface of the placement recess and an outer peripheral surface of the substrate.

In this way, the adhesive can be extruded from the substrate when the substrate is attached to the heat-dissipation plate by the adhesive.

In the seventh, in the light source unit according to the present invention, it is preferable that the light source unit further includes a wiring pattern formed on the substrate, the wiring pattern is respectively formed on a front surface and a rear surface of the substrate, a front-side control element is arranged on the wiring pattern formed on the front surface of the substrate, a rear-side control element is arranged on the wiring pattern formed on the rear surface of the substrate, and at least a portion of the front-side control element and at least a portion of the rear-side control element are arranged offset from each other.

In this way, the front-side control element and the rear-side control element are less likely to be affected to each other by the heat generated from the front-side control element and the rear-side control element during the driving of the light emitting element.

In the eighth, in the light source unit according to the present invention, it is preferable that a first light emitting element to emit light in a first lighting state and a second light emitting element to emit light in a second lighting state are provided as the light emitting element, a first front-side control element to generate heat in the first lighting state and a second front-side control element to generate heat in the second lighting state are provided as the front-side control element, a first rear-side control element to generate heat in the first lighting state and a second rear-side control element to generate heat in the second lighting state are provided as the rear-side control element, at least a portion of the first front-side control element and at least a portion of the first rear-side control element are arranged offset from each other, and at least a portion of the second front-side control element and at least a portion of the second rear-side control element are arranged offset from each other.

In this way, at the time of the driving of each of the first light emitting element and the second light emitting element, the front-side control elements and the rear-side control elements are less likely to be affected to each other by the heat generated from the front-side control elements and the rear-side control elements during the driving of the light emitting elements.

In the ninth, in the light source unit according to the present invention, it is preferable that the substrate is bonded to the heat-dissipation plate by an adhesive, and the adhesive is applied on the rear-side control element.

In this way, a separate waterproofing process on the rear-side control element is not required.

In the tenth, in the light source unit according to the present invention, it is preferable that the adhesive is a silicone resin containing filler.

In this way, the heat-dissipation performance is improved by the filler.

In the eleventh, in the light source unit according to the present invention, it is preferable that the light source unit further includes a wiring pattern formed on the substrate, the substrate is attached to the heat-dissipation plate in the state where the rear side of the substrate faces the first heat-dissipation portion, and a convex portion having a heat-dissipation property is provided at the region of the rear surface of the substrate other than the region having the wiring pattern formed thereon.

In this way, heat is transferred from the convex portion to the heat-dissipation plate.

In the twelfth, in a method of manufacturing a light source unit according to the present invention, a fight source unit includes a socket housing. The socket housing has a heat-dissipation plate formed of a metallic material and a resin molding part formed by solidifying a thermal conductive molten resin. The manufacturing method includes a holding process of supporting a supported portion of the heat-dissipation plate in a cavity of a mold by a movable die and holding the heat-dissipation plate in the cavity; a first filling process of filling the molten resin into the cavity and covering a portion of the heat-dissipation plate excluding a part thereof by the molten resin; and a second filling process of moving the movable die relative to the mold to release a support state of the supported portion and covering the supported portion by the molten resin.

In this way, the heat-dissipation plate is stably held in the cavity by the movable die and the portion of the heat-dissipation plate supported by the movable die is covered by the molten resin.

In the thirteenth, a vehicle lamp according to the present invention includes the light source unit.

In this way, at the time of emission of light from the light emitting element, heat is released from the heat-dissipation plate formed of the metallic material and the resin molding part formed of the thermal conductive resin material.

According to the present invention, at the time of emission of light from the light emitting element, heat is released from the heat-dissipation plate formed of the metallic material and the resin molding part formed of the thermal conductive resin material. Therefore, it is possible to improve the heat-dissipation at the time of emission of light from the light emitting element.

DETAILED DESCRIPTION

Hereinafter, an embodiment for carrying out the present invention will be described with reference to the accompanying drawings.

In the illustrative embodiments described below, a light source unit of the present invention is applied to a light source unit used in a combination lamp having a function of a stop lamp and a tail lamp, a method of manufacturing a light source unit of the present invention is applied to a method of manufacturing this light source unit, undo vehicle lamp of the present invention is applied, to a vehicle lamp including this light source unit. However, it should be noted that the scope of the present invention is not limited to the light source unit used in the combination lamp having the function of the stop lamp and the tail lamp, a light source unit manufacturing method, and the vehicle lamp including the light source unit.

A light source unit of the present invention can be widely applied to a light source unit which is used in various vehicle lamps such as a headlamp, a clearance lamp, a tail lamp, a turn signal lamp, a stop lamp, a daytime running lamp, a cornering lamp, a hazard lamp, a position lamp, a back lamp, a fog lamp, or a combination lamp thereof. Further, the method of manufacturing the light source unit of the present invention can be widely applied to a manufacturing method for these various light source units, and the vehicle lamp of the present invention can be widely applied to a vehicle lamp including these various light source units.

In the following description, a front-rear direction, an up-down direction and a left-right direction are defined in such a manner that an optical axis direction is set as the front-rear direction, and an emission direction of light is set as a rear side. Meanwhile, the front-rear direction, the up-down direction and the left-right direction, which are described below, are defined for convenience of explanation. The practice of the present invention is not limited to these directions.

Figure 1:
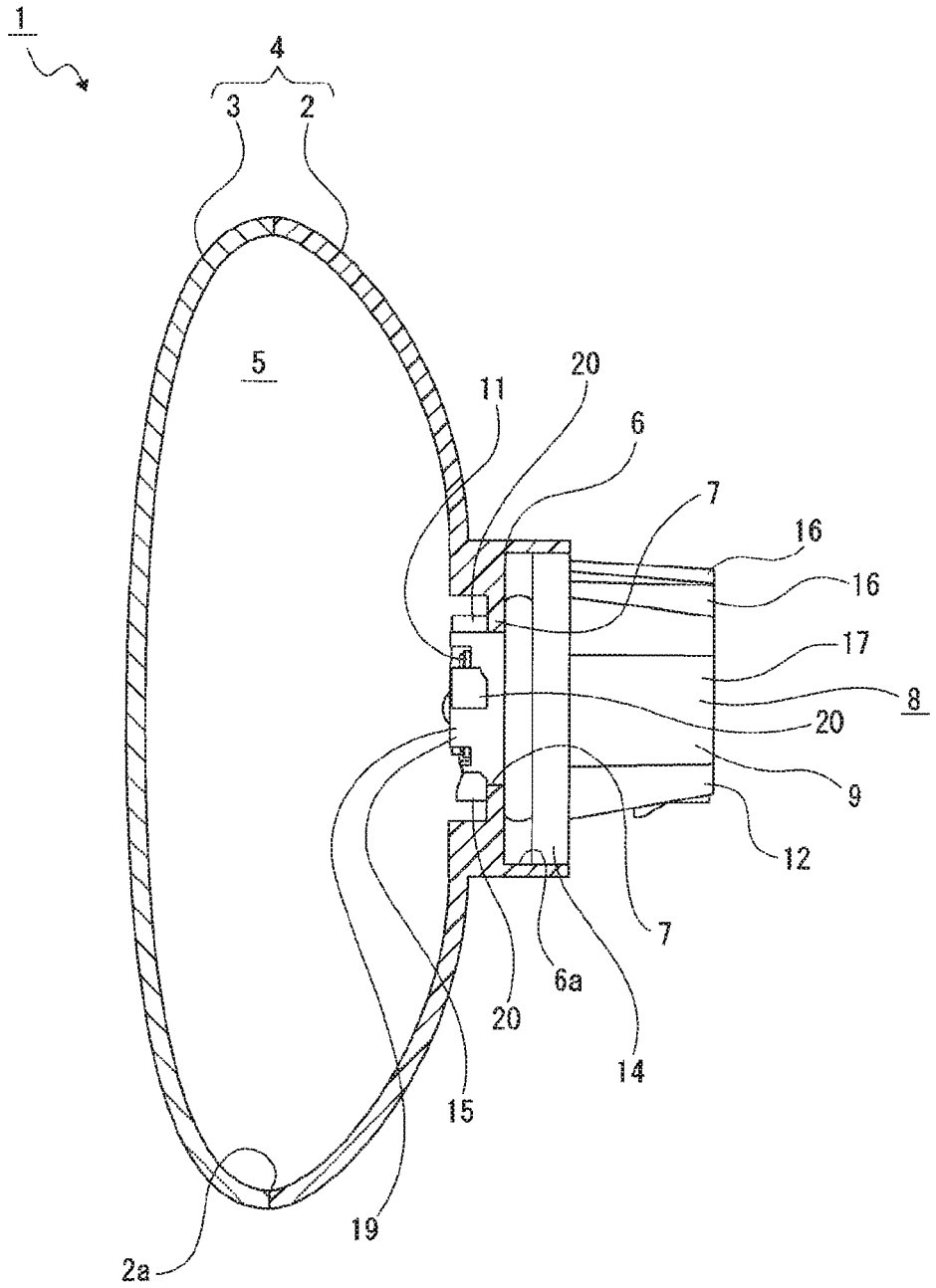
FIG. 1 is a sectional view of a vehicle lamp, showing an illustrative embodiment of the present invention, together with FIGS. 2 to 16.

First, a schematic configuration of a vehicle lamp is described (see FIG. 1).

A vehicle lamp 1 is respectively attached and arranged at both left and right ends of the front end portion of a vehicle body.

The vehicle lamp 1 includes a lamp body 2 having a recess opened rearward and a cover 3 closing a rear opening 2*a* of the lamp body 2. An outer lamp housing 4 is configured by the lamp body 2 and the cover 3. An inner space of the outer lamp housing 4 is formed as a lamp chamber 5.

A front end portion of the lamp body 2 is provided as a substantially cylindrical unit mounting portion 6 that penetrates in the front-rear direction. An internal space of the unit mounting portion 6 is formed as a mounting hole 6*a*. At an inner peripheral surface of the unit mounting portion 6, engaging protrusions 7, 7, . . . protruding inwardly are provided so as to be spaced apart from each other in a circumferential direction.

Subsequently, a structure of a light source unit 8, which is attached to the lamp body 2, is described (see FIGS. 2 to 6).

The light source unit 8 is removably attached to the unit mounting portion 6 of the lamp body 2. The light source unit 8 includes a socket housing 9, a power feeder 10 and a light emitting module 11 (see FIGS. 2 to 6).

The socket housing 9 is formed by an integral molding of a resin molding part 12 and a heat-dissipation plate 13. As the integral molding, for example, a so-called insert molding is used in which a molten resin (resin material) is filled in a state where a metallic material is retained in a cavity of a mold and a molded product is integrally formed by the metallic material and the resin material.

The resin molding part 12 has an excellent thermal conductivity and is formed of, for example, a resin material which contains carbon or the like. The resin molding part 12 also has conductivity. It is preferable that thermal conductivity of the resin molding part 12 is in a range of 1 W/mk to 30 W/mk. Additionally, it is preferable that thermal conductivity of the resin molding part 12 is lower than that of the heat-dissipation plate 13 and higher than that of a terminal holding part 21 (to be described later). The resin molding part 12 has a disc-shaped base surface portion 14 facing the front-rear direction, a protrusion-shaped portion 15 protruding rearward from the center of the base surface portion 14, first heat-dissipation fins 16, 16, . . . protruding forward from the base surface portion 14, second heat-dissipation fins 17, 17 protruding forward from the base surface portion 14, and a connector connection portion 18 protruding forward from the base surface portion 14.

The protrusion-shaped portion 15 includes a substrate placement portion 19 having a circular outer shape and engaging portions 20, 20, . . . provided at an outer peripheral surface of the substrate placement portion 19.

The substrate placement portion 19 is formed with a placement recess 19*a* opened rearward. The placement recess 19*a* has a substantially rectangular shape and is slightly greater than an outer shape of the light emitting module 11. The engaging portions 20, 20, . . . are provided so as to be spaced apart from each other in the circumferential direction. The engaging portions 20, 20, . . . are located at a rear end portion of the substrate placement portion 19.

Figure 6:
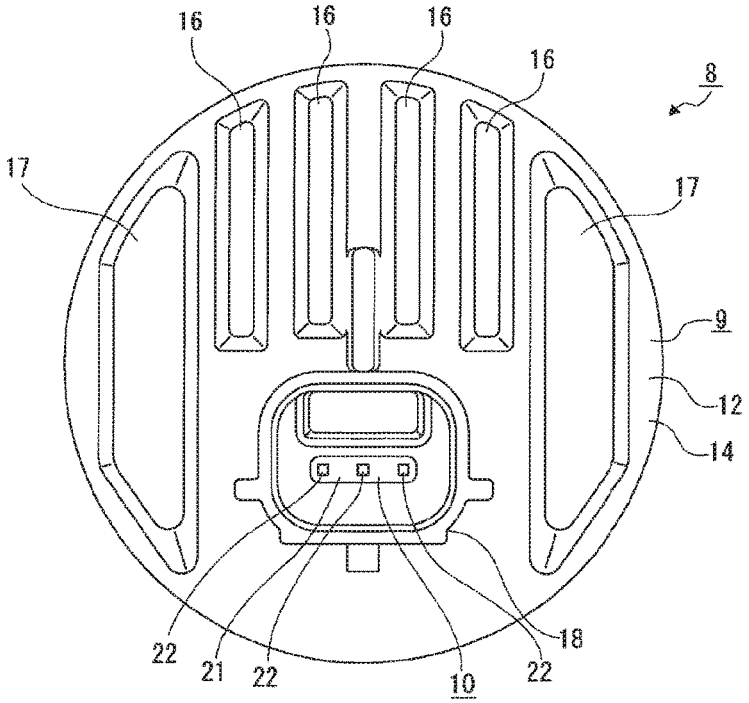
FIG. 6 is a rear view of the light source unit.

The first heat-dissipation fins 16, 16, . . . are provided side by side at equal intervals in the left-right direction, for example, and protrude from an upper half in the portion other than both left and right ends of the base surface portion 14 (see FIG. 6).

The second heat-dissipation fins 17, 17 are respectively disposed at both sides of the first heat-dissipation fins 16, 16, . . . in the left-right direction and protrude from both left and right ends of the base surface portion 14. A thickness in the left-right direction of the second heat-dissipation fins 17, 17 is thicker than a thickness in the left-right direction of the first heat-dissipation fins 16, 16, . . . .

The connector connection portion 18 has a cylindrical shape whose axial direction is the front-rear direction, and is disposed below the first heat-dissipation fin 16, 16, . . . .

Figure 2:
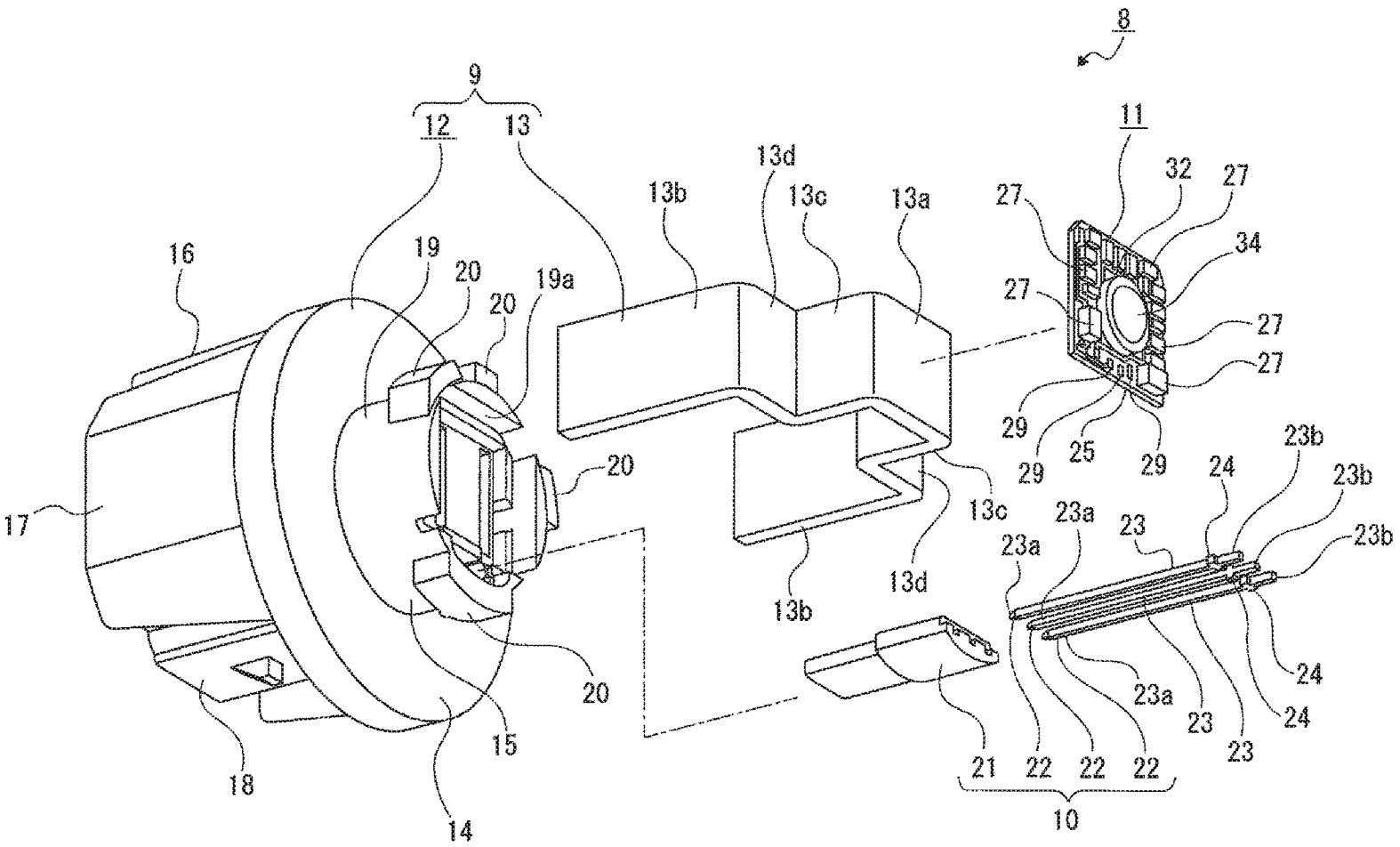
FIG. 2 is an exploded perspective view of a light source unit.
Figure 4:
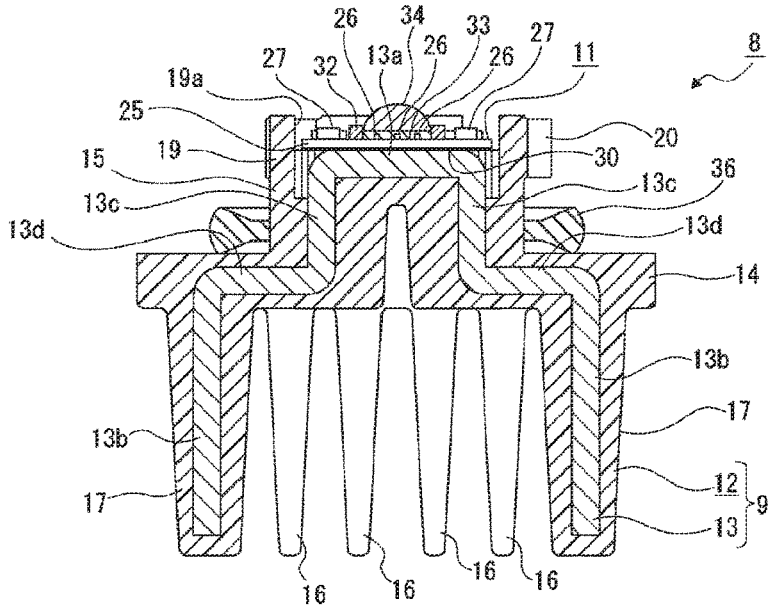
FIG. 4 is a sectional view of the light source unit.
Figure 5:
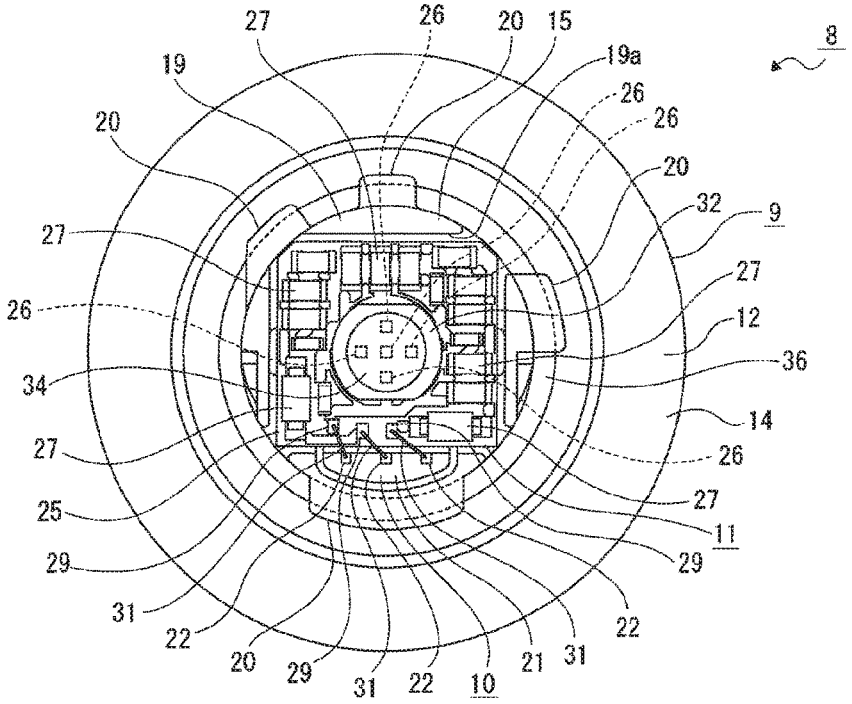
FIG. 5 is a front view of the light source unit.

The heat-dissipation plate 13 is formed in a predetermined shape by a plate-like metallic material such as aluminum having high thermal conductivity (see FIGS. 2 and 4). The heat-dissipation plate 13 includes a first heat-dissipation portion 13*a*, second heat-dissipation portions 13*b*, 13*b*, third heat-dissipation portions 13*c*, 13*c*, and fourth heat-dissipation portions 13*d*, 13*d*.

The first heat-dissipation portion 13*a* and the fourth heat-dissipation portions 13*d*, 13*d* are respectively formed in a substantially rectangular shape facing the front-rear direction. The second heat-dissipation portions 13*b*, 13*b* and the third heat-dissipation portions 13*c*, 13*c* are respectively formed in a substantially rectangular shape facing the left-right direction. Rear ends of the third heat-dissipation portions 13*c*, 13*c* are respectively continuous with both left and right ends of the first heat-dissipation portion 13*a*. Inner ends of the fourth heat-dissipation portions 13*d*, 13*d* are respectively continuous with front ends of the third heat-dissipation portions 13*c*, 13*c* and outer ends thereof are respectively continuous with rear ends of the second heat-dissipation portions 13*b*, 13*b*. Therefore, the third heat-dissipation portions 13*c*, 13*c* are respectively formed by being bent in a direction perpendicular to the first heat-dissipation portion 13*a*. The fourth heat-dissipation portions 13*d*, 13*d* are respectively formed by being bent in a direction perpendicular to the third heat-dissipation portions 13*c*, 13*c*. The second heat-dissipation portions 13*b*, 13*b* are respectively formed by being bent in a direction perpendicular to the fourth heat-dissipation portions 13*d*, 13*d*.

The heat-dissipation plate 13 is configured such that the first heat-dissipation portion 13*a* is disposed in the placement recess 19*a* of the substrate placement portion 19 of the resin molding part 12 and is exposed to the resin molding part 12 (see FIG. 4). The heat-dissipation plate 13 is configured such that the second heat-dissipation portions 13*b*, 13*b* are respectively disposed on the inside of the second heat-dissipation fins 17, 17, the third heat-dissipation portions 13*c*, 13*c* are disposed on the inside of the substrate placement portion 19, and the fourth heat-dissipation portions 13*d*, 13*d* are disposed on the inside of the base snake portion 14.

An insertion and placement hole (not shown) is formed at a position up to the base surface portion 14 from the substrate placement portion 19 of the resin molding part 12. The insertion and placement hole is communicated with the interior of the placement recess 19*a* and the connector coupling portion 18.

The power feeder 10 includes a terminal holding part 21 formed of an insulating resin material and connection terminals 22, 22, 22 (see FIG. 2). The connection terminals 22, 22, 22 are held in the terminal holding part 21 and connected to a power supply circuit (external power; not shown).

The terminal holding part 21 has a flat shape which extends in the front-rear direction and has a thin thickness in the up-down direction.

The connection terminals 22, 22, 22 are formed of a metallic material and disposed side by side in the left-right direction in the interior of the terminal holding part 21 except for a part thereof. Each connection terminal 22 has a terminal portion 23 extending in the front-rear direction and retaining protrusions 24, 24 protruding in opposite directions from a rear end position of the terminal portion 23. A front end portion of the terminal portion 23 is provided as a connector connection portion 23*a* and a rear end portion thereof is provided as a wire connection portion 23*b*. At least a portion of the surface of the wire connection portion 23*b* is subjected to surface treatment by nickel or gold or the like, for example.

The connection terminal 22 is configured such that the connector connection portion 23*a* protrudes forward from the terminal holding part 21 and the wire connection portion 23*b* protrudes rearward from the terminal holding part 21. Since the retaining protrusions 24, 24 are positioned at the inside of the terminal holding part 21, the connection terminal 22 is prevented from being detached from the terminal holding part 21 in the front-rear direction.

The power feeder 10 is integrally formed by an insert molding of the terminal holding part 21 and the connection terminals 22, 22, 22, for example. The power feeder 10 is configured such that the portion other than the connector connection portions 23*a*, 23*a*, 23*a* and the wire connection portions 23*b*, 23*b*, 23*b* is inserted into the insertion and placement hole formed in the resin molding part 12, the connector connection portions 23*a*, 23*a*, 23*a* are disposed at the inside of the connector connection portion 18 (see FIG. 6), and the wire connection portions 23*b*, 23*b*, 23*b* are disposed in the placement recess 19*a* (see FIG. 3).

For example, in the state of being formed by an insert molding, the power feeder 10 is positioned in a cavity of a mold, molten resin for forming the resin molding part 12 is filled into the cavity, and the power feeder 10 is formed integrally with the socket housing 9 by an insert molding, for example.

The light emitting module 11 includes a substrate 25 having a substantially rectangular shape facing the front-rear direction, light emitting elements 26, 26, . . . mounted on the substrate 25, and various control elements 27, 27, . . . mounted on the substrate 25 (see FIGS. 2 to 5).

The substrate 25 is, for example, a ceramic substrate. A wiring pattern for supplying current to the light emitting elements 26, 26, . . . is formed in the substrate 25. The size of the substrate 25 is substantially the same as that of the first heat-dissipation portion 13*a* of the heat-dissipation plate 13.

Figure 7:
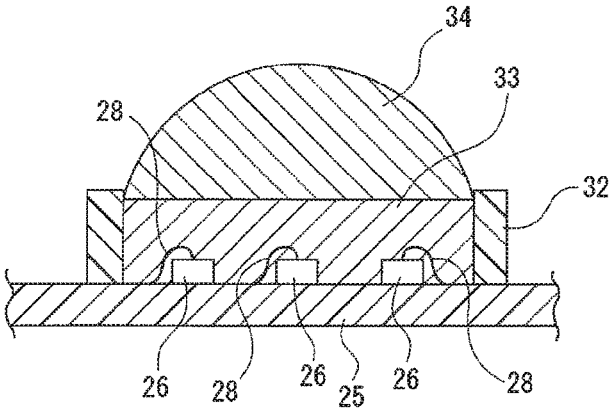
FIG. 7 is a schematic enlarged sectional view showing a state where a light emitting element and a conductive part are sealed and a lens part is disposed on a sealing part.

For example, five light emitting elements 26, 26, . . . are mounted on the center of the substrate 25. Light emitting diodes (LEDs) are used as the light emitting elements 26, 26, . . . . The light emitting elements 26, 26, . . . are configured such that four light emitting elements 26, 26, . . . are mounted around one light emitting element 26 in the state of being spaced apart from each other at equal intervals in the circumferential direction. The center light emitting element 26 serves as a light source for a tail lamp, for example, and four surrounding light emitting elements 26, 26, . . . serve as a light source for a stop lamp, for example. The light emitting elements 26, 26, . . . are respectively connected to the wiring patterns by conductive wires 28, 28, . . . serving as a conductive part (see FIG. 7). Meanwhile, the connection between the light emitting elements 26, 26, . . . and the wiring patterns may be performed by other conductive parts other than the conductive wires 28, 28, . . . , or, may be performed by a flip-chip solder mounting or the like where a solder is used as a conductive part, for example.

The connection terminals 22, 22, 22 are provided as a power supply terminal for a tail lamp, a power supply terminal for a stop lamp, and a power supply terminal for an earth, respectively.

Meanwhile, the number and function of the light emitting element 26 mounted on the substrate 25 can be arbitrarily set, depending on the type and the required brightness or the like of the vehicle lamp 1.

For example, diodes, capacitors or resistors or the like are used as the control elements 27, 27, . . . . The control elements 27, 27, . . . are mounted at positions of the light emitting module 11 on the outside of the light emitting elements 26, 26, . . . and are connected to the wiring patterns, respectively.

A rear surface of the substrate 25 is bonded to the surface of the first heat-dissipation portion 13*a* of the heat-dissipation plate 13 by an adhesive 30 (see FIG. 4). A thermally conductive adhesive is used as the adhesive 30.

Figure 3:
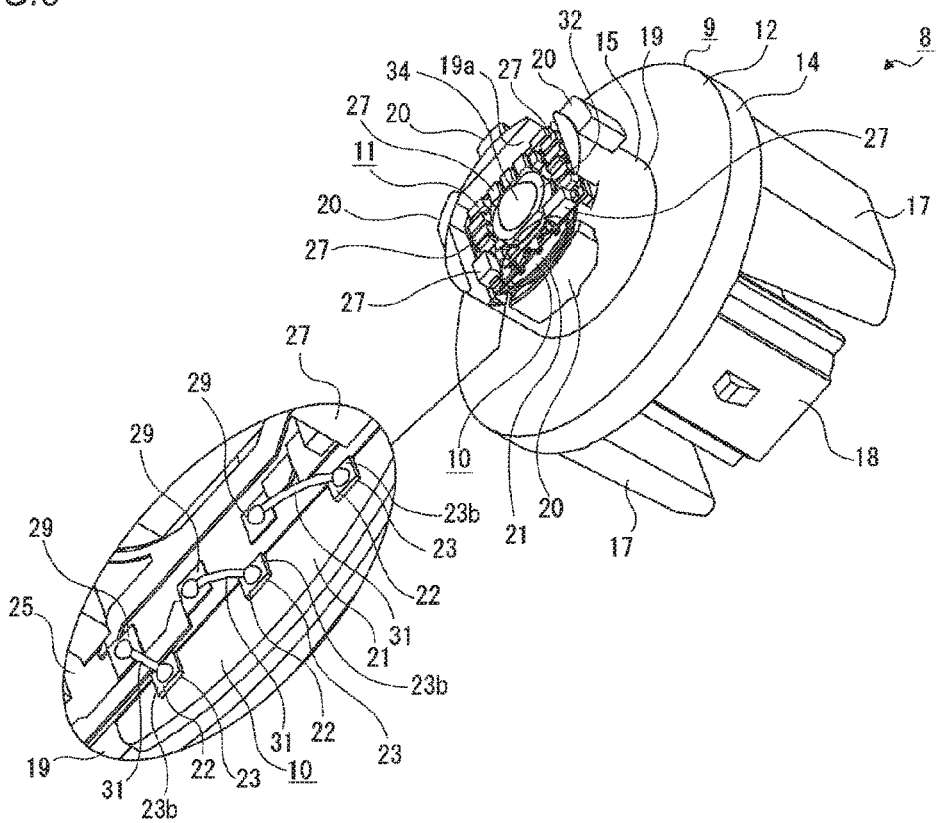
FIG. 3 is a perspective view of the light source unit.

At a lower end portion of the substrate 25, electrode pads 29, 29, 29 are formed side by side in the left-right direction and connected to the wiring patterns (see FIG. 3).

The electrode pads 29, 29, 29 are located in the vicinity of the wire connection portions 23*b*, 23*b*, 23*b* of the connection terminals 22, 22, 22, respectively.

For example, the electrode pads 29, 29, 29 are respectively connected, through soldering or the like, to the wire connection portions 23*b*, 23*b*, 23*b* of the connection terminals 22, 22, 22 by wires 31, 31, 31 formed of aluminum or the like. The connection between the wire connection portion 23*b* and the wire 31 is performed at the portion of the wire connection portion 23*b*, which is subjected to the surface treatment by nickel or gold or the like.

A frame body 32 is attached to the portion of the substrate 25 between the light emitting elements 26, 26, . . . and the control elements 27, 27, . . . (see FIGS. 3, 4 and 7). The frame body 32 is formed in a substantially annular shape by a resin material. The frame body 32 is disposed at a position to surround the light emitting elements 26, 26, . . . and the conductive wires 28 . . . .

A sealing part 33 is disposed inside the frame body 32. The light emitting elements 26, 26, . . . and the conductive wires 28, 28, . . . are sealed by the sealing part 33 (see FIG. 7).

The sealing part 33 is formed in such a way that liquid scaling resin is filled (injected) into the frame body 32 and then cured. In this way, the sealing part 33 seals the light emitting elements 26, 26, . . . and the conductive wires 28, 28, . . . . Therefore, the frame body 32 has a function of determining the sealing part 33 into a predetermined shape by preventing the sealing resin from unnecessarily flowing toward the control elements 27, 27, . . . .

The refractive index of the sealing part 33 has an intermediate value between the refractive index of the light emitting elements 26, 26, . . . and the refractive index of air. Since the light emitting elements 26, 26, . . . are sealed by the sealing part 33, a difference between the refractive index of the light emitting elements 26, 26, . . . and the refractive index of air is alleviated. Therefore, the emission efficiency of fight from the light emitting elements 26, 26, . . . to the outside is improved.

A lens part 34 is disposed on the sealing part 33. The lens part 34 is formed of a predetermined molding resin and has a hemispherical shape which is convex rearward. The lens part 34 is formed in such a manner that, for example, predetermined liquid molding resin is filled and cured on the sealing part 33 before curing or after curing on the inside of the frame body 32. Therefore, the frame body 32 also has a function of determining the lens part into a predetermined shape by preventing the molding resin for forming the lens part 34 from unnecessarily flowing toward the control elements 27, 27, . . . .

The lens part 34 is formed in such a manner that the molding resin is filled and cured on the sealing part 33. Therefore, the frame body 32 also has a function of determining the lens part 34 into a predetermined shape by preventing the molding resin for forming the lens part 34 from unnecessarily flowing toward the control elements 27, 27, . . . .

Further, the refractive index of the lens part 34 has an intermediate value between the refractive index of the light emitting element 26 and the refractive index of air. Since the light emitted from the light emitting elements 26, 26, . . . is less likely to be totally reflected at the interface of the sealing part 33 and the lens part 34, it is possible to improve the emission efficiency of light from the light emitting elements 26, 26, . . . to the outside.

Furthermore, since the frame body 32 is provided, the sealing resin or molding resin is formed in a certain shape even in the case where the injection position of the sealing resin or molding resin is deviated from a predetermined position when the sealing resin or molding resin is injected to the inside of the frame body 32. Therefore, it is possible to improve the molding accuracy of the sealing resin or molding resin.

The molding resin has viscosity higher than that of the sealing resin and has liquidity lower than that of the sealing resin. The viscosity of the molding resin is equal to or greater than 40 Pa·s (pascal·second), for example, and the viscosity of the sealing resin falls in the range of 5 to 15 Pa·s (pascal·second), for example.

When the viscosity of the molding resin is set to be equal to or greater than 40 Pa·s, the molding resin does not flow more than necessary at the time of being injected onto the sealing resin. Therefore, the shape of the lens part 34 is likely to be formed in a desired shape.

On the other hand, when the viscosity of the sealing resin is set to the range of 5 to 15 Pa·s, the sealing resin is flowing in a desired state at the time of being injected onto the substrate 25. Therefore, it is easy to maintain a planar shape and it is possible to secure a good formability. Further, when the viscosity of the sealing resin is set to the range of 5 to 15 Pa·s, the load on the conductive wires 28, 28, . . . becomes small when the sealing resin is injected onto the substrate 25. Therefore, it is possible to suppress the occurrence of disconnection or the like of the conductive wires 28, 28, . . . .

Meanwhile, when the sealing resin is injected, onto the substrate 25, the sealing resin is injected to the inside of the frame body 32 and the shape of the sealing resin (the sealing part 33) is determined by the frame body 32. Therefore, the viscosity of the sealing resin may be less than 5 Pa·s.

Further, there is a case that the lens part 34 is formed by a mold and then disposed on the sealing part 33. In this case, since the lens part 34 is formed into a predetermined shape by the mold, the molding resin having a viscosity less than 40 Pa·s may be used. Meanwhile, it is preferable that, at room temperature (25° C.), the elastic modulus of the sealing part 33 is less than 1 MPa and the elastic modulus of the lens part 34 is equal to or greater than 1 Mpa.

In the state where the lens part 34 is disposed, the light emitting elements 26, 26, . . . and the conductive wires 28, 28, . . . are covered by the lens part 34 in a state of being sealed by the sealing part 33.

Meanwhile, an example where the frame body 32 is formed of a resin material has been illustrated in the above description. However, the frame body 32 may be formed of a metallic material. Further, the frame body 32 may be formed of a resin material and the surface thereof may be subjected to processing such as metal deposition. Furthermore, the frame body 32 may be formed of a white resin. By configuring the frame body 32 in this structure, the frame body 32 can serve as a reflector to reflect a portion of light emitted from the light emitting elements 26, 26, . . . .

Figure 8:
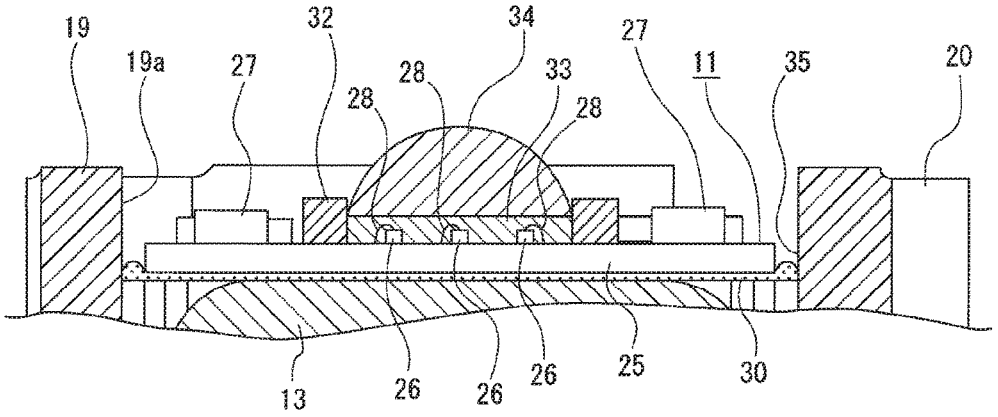
FIG. 8 is an enlarged sectional view showing a state where a substrate is bonded to a heat-dissipation plate.

As described above, the placement recess 19*a* formed in the substrate placement portion 19 of the socket housing 9 is slightly greater than the outer shape of the light emitting module 11. Therefore, in the state where the light emitting module 11 is disposed in the placement recess 19*a*, a gap 35 is formed between an outer peripheral surface of the substrate 25 and an inner peripheral surface of the placement recess 19*a* (see FIG. 8). The gap 35 is filled by the adhesive 30 which is extruded from the rear surface of the substrate 25 when the substrate 25 is attached to the first heat-dissipation portion 13*a* of the heat-dissipation plate 13 by the adhesive 30.

Therefore, by checking the presence and absence of the adhesive 30 in the gap 35, it is possible to determine whether or not the substrate 25 is completely attached to the heat-dissipation plate 13, and it is also possible to confirm the arrangement state of the light emitting module 11 to the socket housing 9.

Further, at the time of attachment of the substrate 25 to the first heat-dissipation portion 13*a*, it is not necessary to reduce the amount of the adhesive 30 in order to avoid the adhesive 30 extruding from the substrate 25. Further, a sufficient amount of adhesive 30 can be used to secure a robust attachment state of the substrate 25 to the first heat-dissipation portion 13*a*.

Furthermore, the substrate 25 can be attached to the first heat-dissipation portion 13*a* in the state where the adhesive 30 is applied on the entire rear surface of the substrate 25. Therefore, during the lighting of the light emitting elements 26, 26, . . . , the heat transfer, which is directed to the first heat-dissipation portion 13*a* through the adhesive 30 from the substrate 25, is increased. In this way, it is possible to improve the heat-dissipation performance.

In the light source unit 8 configured as described above, an annular gasket 36 is fitted and attached to the outside of the protrusion-shaped portion 15 (see FIG. 4). The gasket 36 is formed of a resin material or a rubber material. In the state where the gasket 36 is attached to the light source unit 8, the protrusion-shaped portion 15 is inserted to the unit mounting portion 6 of the lamp body 2 from the front and is rotated in the circumferential direction. In this way, the engaging portions 20, 20, . . . are respectively engaged with the engaging protrusions 7, 7, . . . from the rear (see FIG. 1). At this time, the engaging protrusions 7, 7, are clamped in the engaging portions 20, 20, . . . and the gasket 36, and hence, the light source unit 8 is attached to the lamp body 2. In the state where the light source unit 8 is attached to the lamp body 2, the unit mounting portion 6 is closed by the gasket 36, and hence, foreign matters such as moisture are prevented from entering the lamp chamber 5 through the unit mounting portion 6 from the outside.

On the contrary, when the light source unit 8 is rotated in a direction opposite to the above direction along the circumferential direction, the engagement of the engaging portions 20, 20, . . . to the engaging protrusions 7, 7, . . . is released, and hence, the protrusion-shaped portion 15 can be pulled from the unit mounting portion 6. In this way, the light source unit 8 can be detached from the lamp body 2.

When current is supplied to the wiring pattern through the connection terminals 22, 22, 22 from the power supply circuit in the state where the light source unit 8 is attached to the lamp body 2, light is emitted from at least one light emitting element 26. At this time, when the vehicle lamp 1 serves as a tail lamp, light is emitted from one light emitting element 26 located at the center. Further, when the vehicle lamp 1 serves as a stop lamp, light is emitted from four light emitting elements 26, 26, . . . other than the one located at the center.

The light emitted from the light emitting element 26 is transmitted through the sealing part 33 and the lens part 34 and is irradiated to the outside through the cover 3. At this time, the irradiation direction of the light is controlled by the lens part 34, so that the light is irradiated to the outside toward a predetermined direction. At this time, when the frame body 32 serves as a reflector, a portion of the light emitted from the light emitting element 26 is irradiated to the outside by being reflected in the frame body 32.

At the time of emission of the light from the light emitting element 26, heat is generated in the light emitting module 11. However, the generated heat is transmitted to the first heat-dissipation portion 13*a* through the adhesive 30 having excellent thermal conductivity, and is transmitted to the heat-dissipation plate 13 and the resin molding part 12. The heat, which is transmitted to the heat-dissipation plate 13 and the resin molding part 12, is mainly dissipated to the outside from the first heat-dissipation fins 16, 16, . . . and the second heat-dissipation fins 17, 17.

As described above, the vehicle lamp 1 is configured such that the heat-dissipation plate 13 is provided with the first heat-dissipation portion 13*a* in contact with the substrate 25, the resin molding part 12 is provided with the first heat-dissipation fins 16, 16, . . . and the second heat-dissipation fins 17, 17, and the socket housing 9 is formed by an integral molding of the heat-dissipation plate 13 and the resin molding part 12.

Therefore, at the time of emission of light from the light emitting element 26, heat is released from the heat-dissipation plate 13 formed of the metallic material and the resin molding part 12 formed of the thermal conductive resin material. Accordingly, it is possible to improve the heat-dissipation at the time of emission of light from the light emitting element 26.

Further, since the socket housing 9 is formed by the resin molding part 12 and the heat-dissipation plate 13, instead of being entirely configured by the heat-dissipation plate, it is possible to reduce the manufacturing cost and it is also possible to improve the heat-dissipation at the time of emission of light from the light emitting element 26.

Further, since the heat-dissipation plate 13 is provided with the second heat-dissipation portions 13*b*, 13*b* perpendicular to the first heat-dissipation portion 13*a*, heat is also released from the second heat-dissipation portions 13*b*, 13*b*, in addition to the first heat-dissipation portion 13*a*. As a result, it is possible to further improve the heat dissipation.

Furthermore, since the light source unit 8 is configured such that the second heat-dissipation portions 13*b*, 13*b* are respectively disposed on the inside of the second heat-dissipation fins 17, 17 located at the outermost side, the second heat-dissipation portions 13*b*, 13*b* are disposed on the outside of the first heat-dissipation fins 16, 16, . . . . As a result, it is possible to improve the strength of the light source unit 8.

Especially, the second heat-dissipation fins 17, 17 are portions which are gripped at the time of attachment and detachment of the light source unit 8 to the lamp body 2 and to which a force from a finger is likely to be applied. Therefore, when the second heat-dissipation portions 13*b*, 13*b* are respectively disposed on the inside of the second heat-dissipation fins 17, 17, and hence, the strength is improved, it is possible to easily and properly perform the attachment and detachment of the light source unit 8 to the lamp body 2.

Furthermore, the heat-dissipation plate 13 is provided with the third heat-dissipation portions 13*c*, 13*c* which are perpendicular to the first heat-dissipation portion 13*a* and are continuous with the first heat-dissipation portion 13*a*.

In this way, since heat is also dissipated from the third heat-dissipation portions 13*c*, 13*c*, in addition to the first heat-dissipation portion 13*a* and the second heat-dissipation portions 13*b*, 13*b*, it is possible to further improve the heat dissipation. Further, since the first heat-dissipation portion 13*a* and the third heat-dissipation portions 13*c*, 13*c* are continuously provided in a state of being perpendicular to each other, it is possible to improve the strength of the light source unit 8.

In addition, the heat-dissipation plate 13 is provided with the fourth heat-dissipation portions 13*d*, 13*d* which are bent in a direction perpendicular to both of the second heat-dissipation portions 13*b*, 13*b* and the third heat-dissipation portion 13*c*, 13*c* and are continuous with both of the second heat-dissipation portions 13*b*, 13*b* and the third heat-dissipation portion 13*c*, 13*c*.

In this way, since heat is also dissipated from the fourth heat-dissipation portions 13*d*, 13, in addition to the first heat-dissipation portion 13*a*, the second heat-dissipation portions 13*b*, 13*b* and the third heat-dissipation portions 13*c*, 13, it is possible to further improve the heat dissipation. Further, since the fourth heat-dissipation portions 13*d*, 13*d* are continuously provided in a state of being perpendicular to both of the second heat-dissipation portions 13*b*, 13*b* and the third heat-dissipation portions 13*c*, 13*c*, it is possible to further improve the strength of the light source unit 8.

Hereinafter, another example of the light source unit will be described (see FIGS. 9 to 13).

Meanwhile, a light source unit 8A according to another embodiment described below is different from the light source unit 8 described above only in configurations of the light source module and a part of components associated therewith. Therefore, only the portions of the light source unit 8A different from the light source unit 8 are described in detail, and the other portions thereof are denoted by the same reference numerals as the corresponding portions of the light source unit 8 and a description thereof is omitted.

Figure 9:
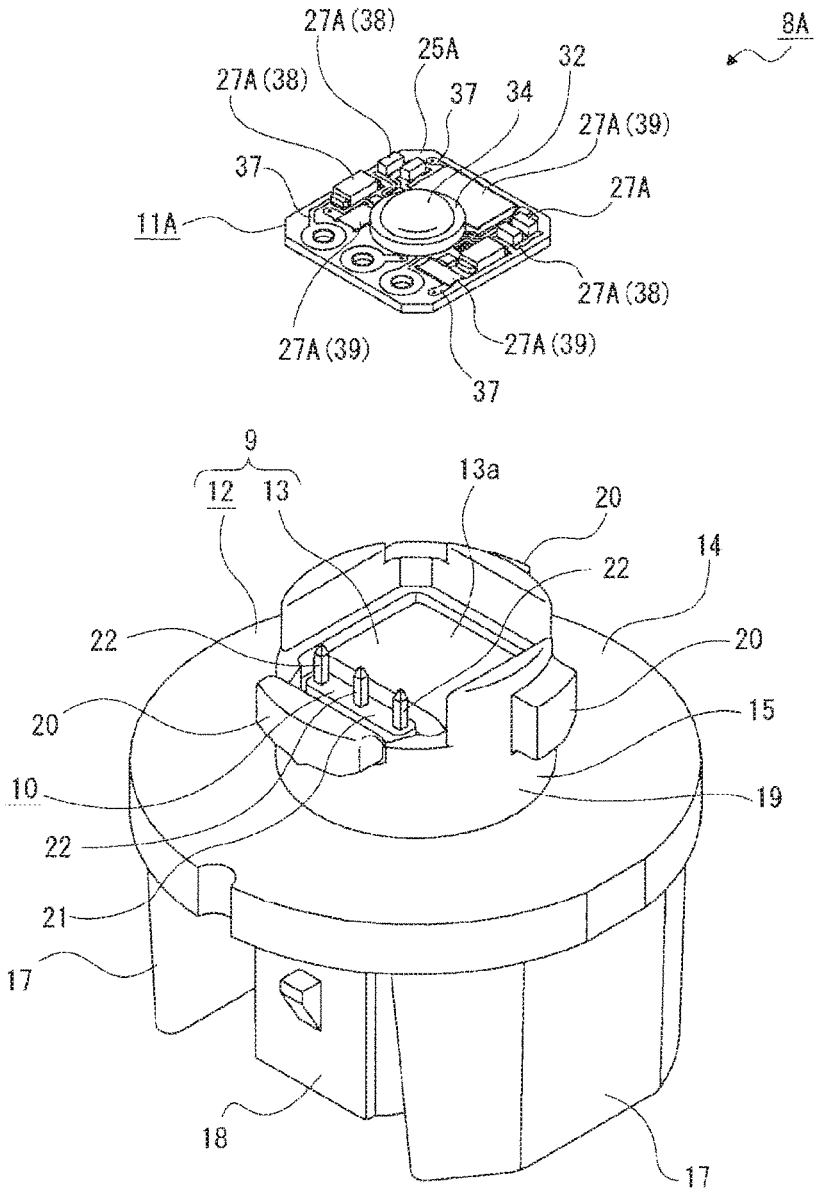
FIG. 9 is a perspective view of the light source unit shown in a state where a socket housing and a light emitting module are separated.

The light source unit 8A includes the socket housing 9, the power feeder 10 and a light emitting module 11A (see FIG. 9).

Figure 10:
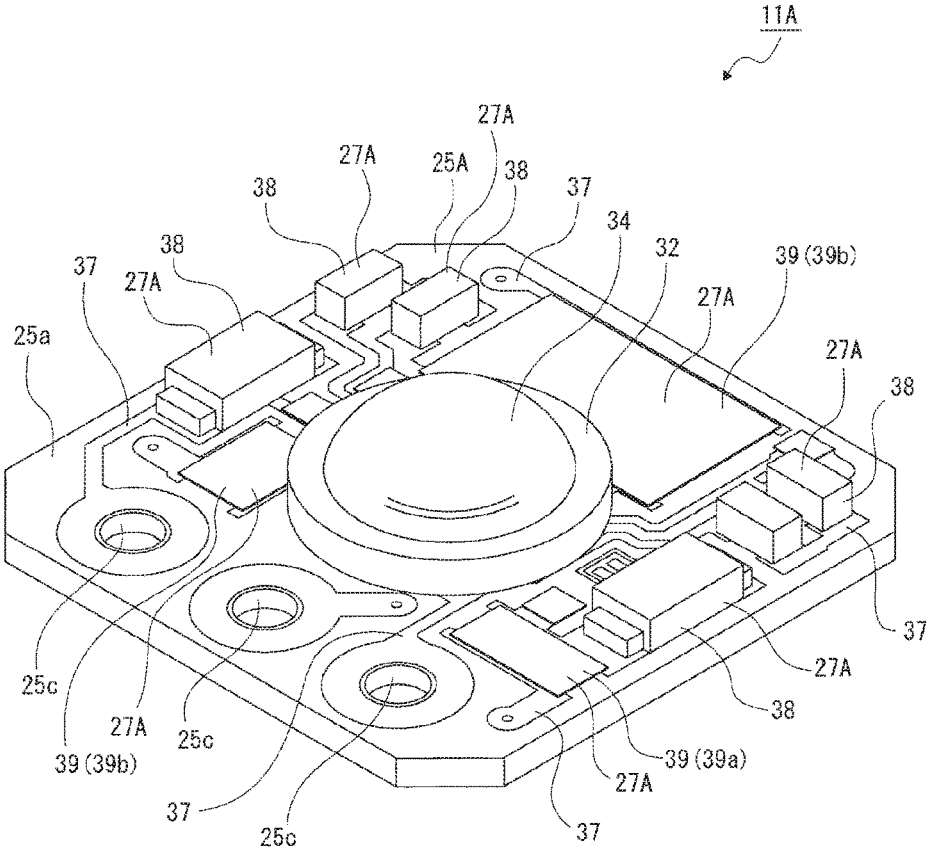
FIG. 10 is an enlarged perspective view of the light emitting module.
Figure 11:
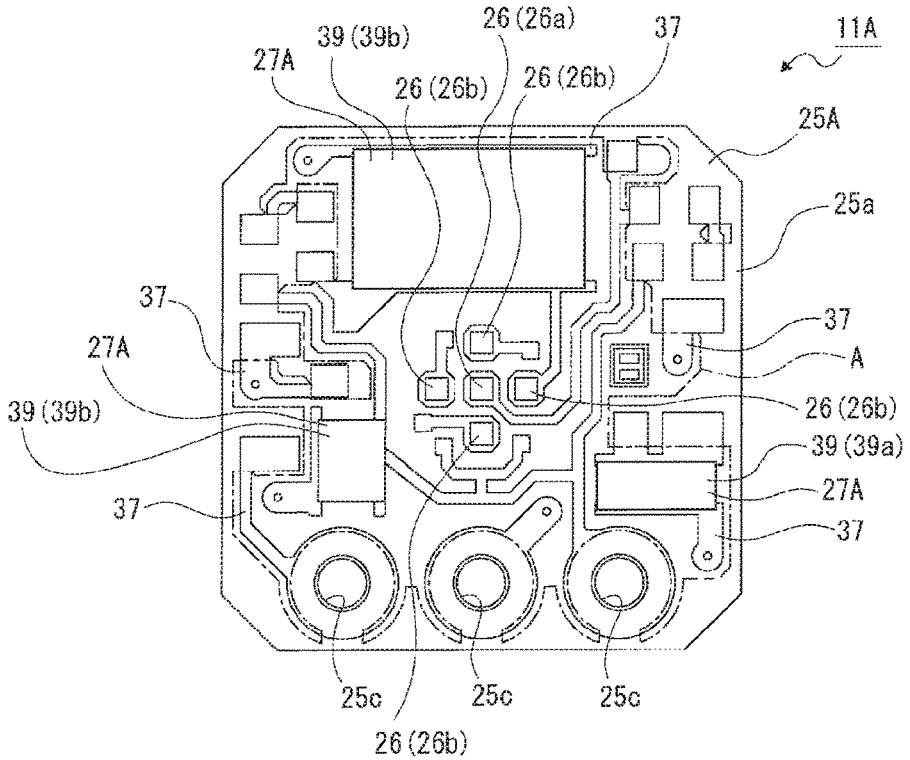
FIG. 11 is an enlarged front view of the light emitting module shown in a state where an electronic component is omitted.
Figure 12:
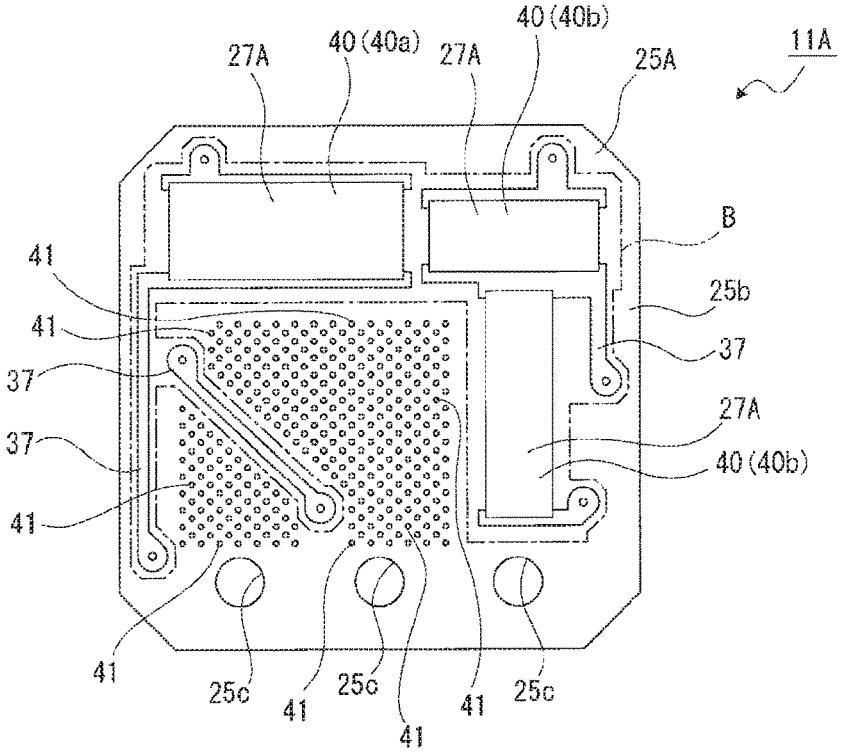
FIG. 12 is an enlarged rear view of the light emitting module shown in a state where an electronic component is omitted.
Figure 13:
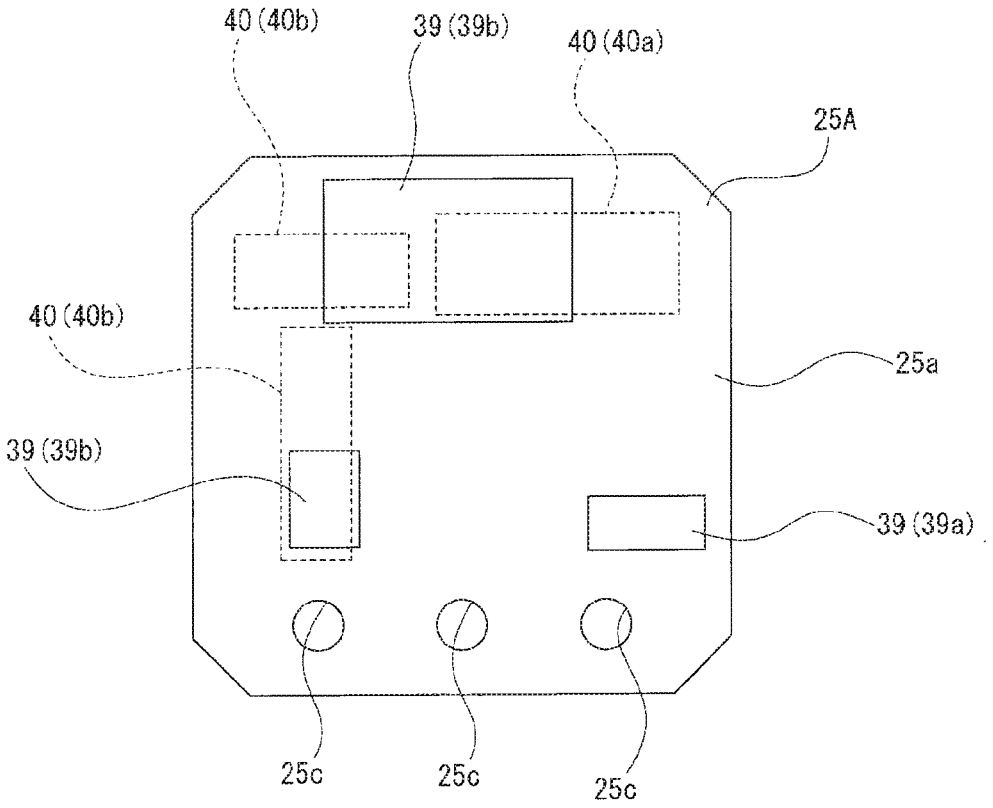
FIG. 13 is an enlarged plan view showing an overlapping state of a front-side printed resistor and a rear-side printed resistor.

The light emitting module 11A includes a substrate 25A having a substantially rectangular shape facing the front-rear direction, the light emitting elements 26, 26, . . . mounted on a front surface 25*a* of the substrate 25A, and various control elements 27A, 27A, . . . mounted on the front surface 25*a* and a rear surface 25*b* of the substrate 25A (see FIGS. 10 to 12).

The substrate 25A is, for example, a ceramic substrate. Wiring patterns 37, 37, . . . for performing an operation or the like to supply current to the light emitting elements 26, 26, . . . are formed in the substrate 25A. Insertion holes 25*c*, 25*c*, 25*c* are formed in one end portion of the substrate 25A. The connection terminals 22, 22, 22 of the power feeder 10 are inserted through the insertion holes 25*c*, 25*c*, 25*c*, respectively.

In the light emitting elements 26, 26, . . . , the center first light emitting element 26*a* serves as a light source for a tail lamp, for example, and four second surrounding light emitting elements 26*b*, 26*b*, . . . serve as a light source for a stop lamp, for example. The light emitting elements 26, 26, . . . are connected to the wiring patterns 37, 37, . . . by the conductive wires 28, 28, . . . .

For example, electronic components 38, 38, . . . such as diodes and capacitors, or printed resistors 39, 39, 39, 40, 40, 40 formed by a printing technique are provided as the control elements 27A, 27A, . . . . The control elements 27A, 27A, . . . are mounted at positions outside of the frame body 32 and connected to the wiring patterns 37, 37, . . . , respectively. The printed resistors 39, 39, 39, 40, 40, 40 are elements which have an especially large amount of heat generation at the time of emission (driving) of the light emitting elements 26, 26, . . . .

The electronic components 38, 38, and the printed resistors 39, 39, 39 are arranged on the front surface 25*a* of the substrate 25A, and the printed resistors 40, 40, 40 are arranged on the rear surface 25*b* of the substrate 25A. The printed resistors 39, 39, 39 arranged on the front surface 25*a* are the front-side control elements, and the printed resistors 40, 40, 40 arranged on the rear surface 25*b* are the rear-side control elements.

Out of the printed resistors 39, 39, 39, a resistor associated with the driving of the first light emitting element 26*a* for the tail lamp is the first front-side control element 39*a*, and resistors associated with the driving of the second light emitting elements 26*b*, 26*b* for the stop lamp are the second front-side control elements 39*b*, 39*b*. Further, out of the printed resistors 40, 40, 40, a resistor associated with the driving of the first light emitting element 26*a* for the tail lamp is the first rear-side control element 40*a*, and resistors associated with the driving of the second light emitting elements 26*b*, 26*b* for the stop lamp are the second rear-side control elements 40*b*, 40*b*.

On the rear surface 25*b* of the substrate 25A, point-like convex portions 41, 41, . . . formed of a metallic material having a heat-dissipation property, such as copper, are provided in a matrix shape. The convex portions 41, 41, . . . are provided at positions in which the wiring patterns 37, 37, . . . and the printed resistors 40, 40, 40 are not present, and the thickness thereof is substantially equal to that of the printed resistors 40, 40, 40.

Overcoat glass (not shown) is applied on the front surface 25*a* and the rear surface 25*b* of the substrate 25A, respectively. The overcoat glass is a coating for achieving an insulation of several μm to several tens μm in thickness. The overcoat glass is applied on each region (regions A, B inside a dashed line shown in FIGS. 11 and 12) where the control elements 27A, 27A, . . . or the wiring patterns 37, 37, . . . are present and insulation is required. Since the overcoat glass is a thin film, the heat generated in the light emitting module 11A is released to the outside through the overcoat glass.

In the state where the light emitting module 11A configured as described above is placed in the placement recess 19*a* of the socket housing 9, one end portions of the connection terminals 22, 22, 22 are respectively inserted through the insertion holes 25*c*, 25*c*, 25*c* of the substrate 25A, and the connection terminals 22, 22, 22 and the wiring patterns 37, 37, 37 are respectively connected by a soldering.

In the light emitting module 11A, the substrate 25A is used as a double-sided substrate. At least a portion of the printed resistors 39, 39, 39 serving as the front-side control element arranged on the front surface 25*a* and at least a portion of the printed resistors 40, 40, 40 serving as the rear-side control element arranged on the rear surface 25*b* are arranged offset from each other on the front and rear surfaces (see FIG. 13).

Therefore, the printed resistors 39, 39, 39 serving as the front-side control element and the printed resistors 40, 40, 40 serving as the rear-side control element are less likely to be affected to each other by the heat generated from the printed resistors 39, 39, 39, 40, 40, 40 during the driving of the light emitting elements 26, 26, . . . . As a result, it is possible to improve the reliability of the operation of the light emitting module 11A.

Specifically, the first front-side control element 39*a* arranged on the front surface 25*a* and the first rear-side control element 40*a* arranged on the rear surface 25*b* are in the state where both do not entirely overlap on the front and rear surfaces. Further, the second front-side control elements 39*b*, 39*b* arranged on the front surface 25*a* and the second rear-side control elements 40*b*, 40*b* arranged on the rear surface 25*b* are in the state where only a portion of both overlaps and substantially the entire other portions thereof do not overlap on the front and rear surfaces.

In this way, in the light emitting module 11A, the first front-side control element 39*a* and the first rear-side control element 40*a*, which are associated with the driving of the first light emitting element 26*a*, are arranged so as to be entirely shifted, and the second front-side control elements 39*b*, 39*b* and the second rear-side control elements 40*b*, 40*b*, which are associated with the driving of the second light emitting elements 26*b*, 26*b*, are arranged so as to be substantially entirely shifted. Namely, at least a portion of the first front-side control element 39*a* and at least a portion of the first rear-side control element 40*a* are arranged offset from each other, and at least a portion of the second front-side control elements 39*b*, 39*b* and at least a portion of the second rear-side control elements 40*b*, 40*b* are arranged offset from each other.

Therefore, the printed resistors 39, 39, 39 and the printed resistors 40, 40, 40 are less likely to be affected to each other by the heat generated during the driving of each of the first light emitting element 26*a* and the second light emitting elements 26*b*, 26*b*. As a result, it is possible to improve the reliability of the driving operation of the first light emitting element 26*a* and the driving operation of the second light emitting elements 26*b*, 26*b* . . . .

Meanwhile, similarly to the relation between the first front-side control element 39*a* and the first rear-side control element 40*a*, the second front-side control elements 39*b*, 39*b* and the second rear-side control elements 40*b*, 40*b* may be in the state where both do not entirely overlap on the front and rear surfaces.

In the state where the light emitting module 11A is placed in the placement recess 19*a* of the socket housing 9, the substrate 25A is attached to the heat-dissipation plate 13 in the state where the rear surface 25*b* faces the first heat-dissipation portion 13*a*. At this time, the light emitting module 11A is configured such that the substrate 25A is a double-sided substrate and the printed resistors 40, 40, 40 are formed on the rear surface 25*b*. Therefore, a gap occurs between the substrate 25A and the first heat-dissipation portion 13*a*, correspondingly. Further, the convex portions 41, 41, . . . having a heat-dissipation property are formed on the rear surface 25*b*.

Therefore, since the convex portions 41, 41, . . . are in contact with the first heat-dissipation portion 13*a*, the heat generated in the light emitting module 11A is respectively transferred to the heat-dissipation plate 13 from the printed resistors 40, 40, 40 and the convex portions 41, 41, . . . . In this way, it is possible to secure a good heat-dissipation property at the time of the driving of the light emitting elements 26, 26, . . . .

Further, in the light emitting module 11A, a material having a heat-dissipation property may be applied on the entire surface of the portion of the rear surface 25*b* of the substrate 25A, on which the wiring patterns 37, 37, . . . are not formed. However, when the material having the heat-dissipation property is applied on the entire surface of the portion of the rear surface 25*b*, there is a possibility that deflection occurs in the substrate 25A. Therefore, by providing the point-like convex portions 41, 41, . . . in a matrix shape on the rear surface 25*b* as described above, a good heat-dissipation property can be secured and the occurrence of deflection of the substrate 25A can be suppressed.

The substrate 25A is attached to the heat-dissipation plate 13 by a thermal conductive adhesive applied on the rear surface 25*b*. In this case, when the adhesive is applied on the entire rear surface 25*b*, insulation on the heat-dissipation plate 13 can be achieved. In the light emitting module 11A, a trimming process for cutting a portion of the front surface is often performed so as to set resistance values of the control elements 27, 27, . . . serving as resistors to predetermined values. Therefore, when the trimming process is performed on, for example, the first rear-side control element 40*a* or the second rear-side control elements 40*b*, 40*b*, a separate waterproofing process for the trimmed portion is not required by applying the adhesive on the entire rear surface 25*b*. In this way, it is possible to reduce manufacturing cost.

Further, when a silicone resin containing filler is used as the adhesive, the heat-dissipation performance can be improved by the filler, the manufacturing cost can be reduced, and a high heat-dissipation property of the light emitting module 11A can be secured.

Figure 14:
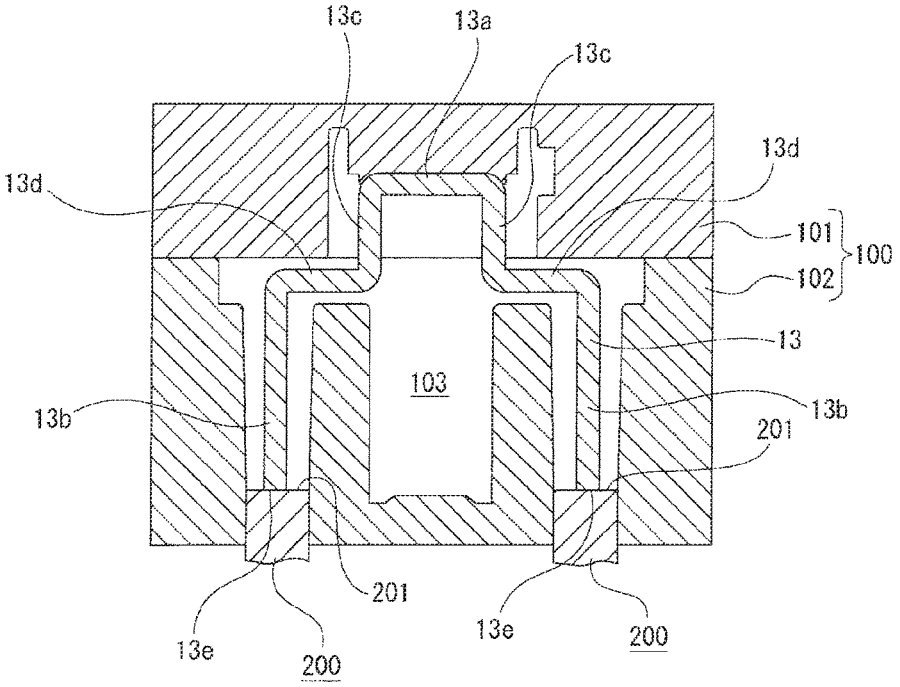
FIG. 14 shows an example of a method of manufacturing the socket housing, together with FIGS. 15 and 16, and is a schematic sectional view showing a state in a holding process.
Figure 15:
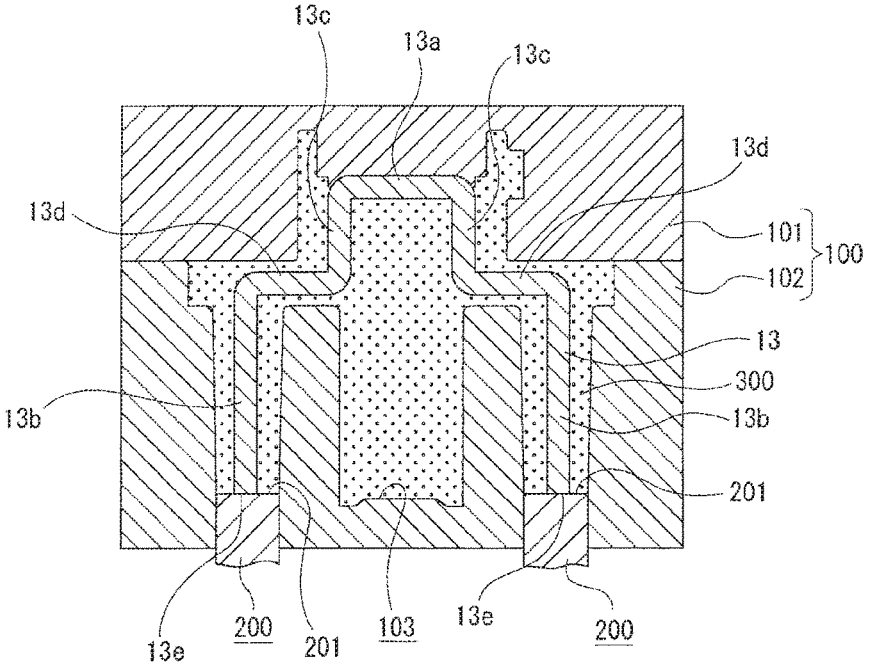
FIG. 15 is a schematic sectional view showing a state in a first filling process.
Figure 16:
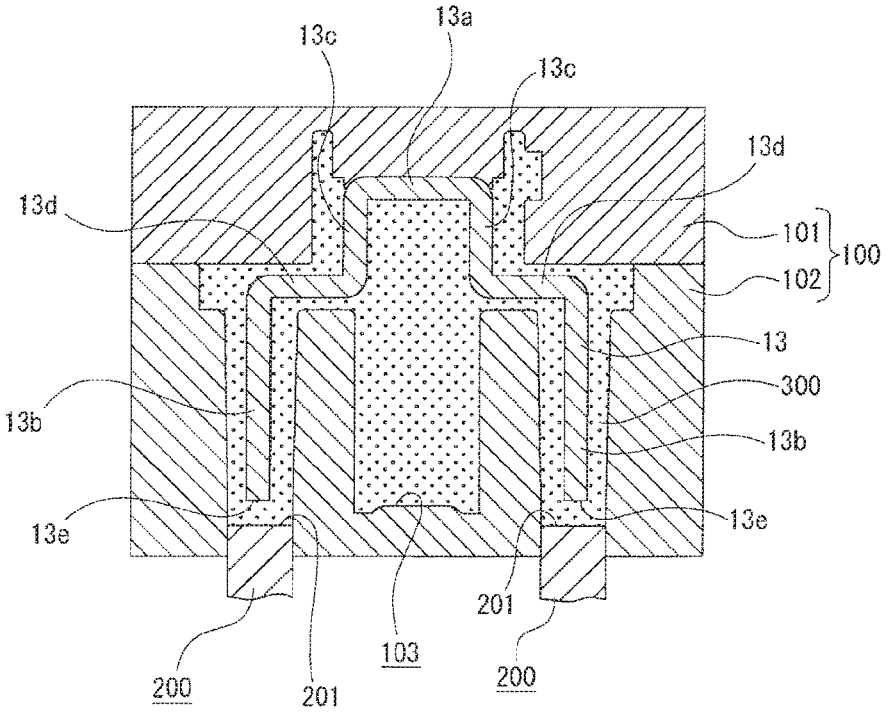
FIG. 16 is a schematic sectional view showing a state in a second filling process.

Next, an example of a method for manufacturing the socket housing 9 is described (see FIGS. 14 to 16). The socket housing 9 is formed by an injection molding (insert molding) using a mold 100 and movable dies 200, 200. Meanwhile, in the drawings to be referred below, the mold 100 and the movable dies 200, 200 or the like are schematically shown so as to facilitate the understanding of description.

The mold 100 includes a first mold 101 and a second mold 102. An internal space of the mold 100 formed by the abutment of the first mold 101 and the second mold 102 is formed as a cavity 103 (see FIG. 14).

The movable dies 200, 200 are configured by sliders or the like and movably supported on the mold 100. Support portions 201, 201 are respectively provided on leading end portions of the movable dies 200, 200.

When molding the socket housing 9, first, a holding process is performed. In the holding process, the heat-dissipation plate 13 is inserted into the cavity 103 and the heat-dissipation plate 13 is held by the movable dies 200, 200 (see FIG. 14).

Lower end portions of the second heat-dissipation portions 13*b*, 13*b* are supported by the support portions 201, 201, so that the heat-dissipation plate 13 is held by the movable dies 200, 200. Therefore, the lower end portions of the second heat-dissipation portions 13*b*, 13*b* are supported portions 13*e*, 13*e* which are supported by the support portions 201, 201, respectively. At this time, for example, a portion of an inner surface of the mold 100 is in contact with the front surface of the heat-dissipation portion 13*a* of the heat-dissipation plate 13. Further, in the holding process, the support portions 201, 201 of the movable dies 200, 200 are positioned in the cavity 103.

Subsequently, a first filling process is performed. In the first filling process, the molten resin 300 is filled into the cavity 103 through a gate (not shown) (see FIG. 5).

When the molten resin 300 is filled into the cavity 103, the portion of the heat-dissipation plate 13 excluding a part thereof is covered by the molten resin 300. That is, the portion of the heat-dissipation plate 13 excluding the front surface of the first heat-dissipation portion 13*a* and the supported portions 13*e*, 13*e* is covered by the molten resin 300.

Subsequently, a second filling process is performed. In the second filling process, the movable dies 200, 200 are moved in a direction away from the heat-dissipation plate 13 and the molten resin 300 is continuously filed into the cavity 103 (see FIG. 16).

When the movable dies 200, 200 are moved in the direction away from the heat-dissipation plate 13, the support state of the supported portions 13*e*, 13*e* by the support portions 201, 201 is released. At this time, since the molten resin 300 is continuously filled into the cavity 103, the supported portions 13*e*, 13*e* are covered by the molten resin 300.

Subsequently, the molten resin 300 is molded as the resin molding part 12 by being cooled and solidified. The resin molding, part 12 and the heat-dissipation plate 13 are integrally formed as the socket housing 9 by an insert molding. By opening the first mold 101 and the second mold 102, the socket housing 9 formed is taken out from the mold 100.

In the manufacturing method described above, the heat-dissipation plate 13 is stably held by the movable dies 200, 200 and the portion of the heat-dissipation plate 13 supported by the movable dies 200, 200 is also covered by the molten resin 300. In this way, a good formability of the socket housing 9 can be secured.

Further, since the second holding portions 13*b*, 13*b* of the heat-dissipation plate 13 are entirely covered by the resin molding part 12, moisture is prevented from entering between the second holding portions 13*b*, 13*b* and the resin molding part 12. In this way, it is possible to achieve a high waterproof property of the socket housing 9.

The invention claimed is:

1. A light source unit comprising:

a socket housing that comprises a heat-dissipation plate formed of a metallic material, and a resin molding part;

a substrate mounted on the socket housing; and a light emitting element serving as a light source and mounted on the substrate, wherein the heat-dissipation plate is provided with a first heat-dissipation portion that is a single flat plate portion, and the first heat-dissipation portion has a front surface that is directly attached to the substrate, wherein the first heat-dissipation portion has a rear surface that is in direct contact with the resin molding part, the resin molding part is single injection molded part that includes a plurality of heat-dissipation fins and a plurality of engaging protrusions circumferentially arranged around a center axis of the resin molding part that are configured to be engaged with a predetermined member, wherein the heat-dissipation plate extends into two fins of the plurality of heat-dissipation fins, and the socket housing is produced by a process of integrally molding the heat-dissipation plate and the resin molding part.

2. The light source unit according to claim 1, wherein the heat-dissipation plate is provided with a second heat-dissipation portion perpendicular to the first heat-dissipation portion.

3. The light source unit according to claim 2, wherein the second heat-dissipation portion is positioned at an inside of an outermost heat-dissipation fin out of the plurality of heat-dissipation fins.

4. The light source unit according to claim 2, wherein the heat-dissipation plate is provided with a third heat-dissipation portion which is bent in a direction perpendicular to the first heat-dissipation portion and is continuous with the first heat-dissipation portion.

5. The light source unit according to claim 4, wherein the heat-dissipation plate is provided with a fourth heat-dissipation portion which is bent in a direction perpendicular to both of the second heat-dissipation portion and the third heat-dissipation portion and is continuous with both of the second heat-dissipation portion and the third heat-dissipation portion.

6. The light source unit according to claim 1, wherein the socket housing is formed with a placement recess in which the substrate is placed, the substrate is attached to the heat-dissipation plate by an adhesive, and a gap is formed between an inner peripheral surface of the placement recess and an outer peripheral surface of the substrate.

7. The light source unit according to claim 1, further comprising a wiring pattern formed on the substrate, wherein the wiring pattern is respectively formed on a front surface and a rear surface of the substrate, a front-side control element is arranged on the wiring pattern formed on the front surface of the substrate, a rear-side control element is arranged on the wiring pattern formed on the rear surface of the substrate, and at least a portion of the front-side control element and at least a portion of the rear-side control element are arranged offset from each other.

8. The light source unit according to claim 7, wherein a first light emitting element to emit light in a first lighting state and a second light emitting element to emit light in a second lighting state are provided as the light emitting element, a first front-side control element to generate heat in the first lighting state and a second front-side control element to generate heat in the second lighting state are provided as the front-side control element, a first rear-side control element to generate heat in the first lighting state and a second rear-side control element to generate heat in the second lighting state are provided as the rear-side control element, at least a portion of the first front-side control element and at least a portion of the first rear-side control element are arranged offset from each other, and at least a portion of the second front-side control element and at least a portion of the second rear-side control element are arranged offset from each other.

9. The light source unit claim 7, wherein the substrate is bonded to the heat-dissipation plate by an adhesive, and the adhesive is applied on the rear-side control element.

10. The light source unit according to claim 9, wherein the adhesive is a silicone resin containing filler.

11. The light source unit according to claim 1, further comprising a wiring pattern formed on the substrate, wherein a convex portion having a heat-dissipation property is provided at a region of a rear side of the substrate other than the region having the wiring pattern formed thereon.

12. The light source unit according to claim 1, wherein the two fins of the plurality of heat-dissipation fins are the only fins that receive the heat-dissipation plate.

13. A vehicle lamp comprising a light source unit according to claim 1.

* * * * *